US010315431B2

(12) United States Patent
Coma Vives et al.

(10) Patent No.: US 10,315,431 B2
(45) Date of Patent: Jun. 11, 2019

(54) PRINTING FLUID CIRCULATION

(71) Applicants: Hewlett-Packard Development Company, L.P., Houston, TX (US); Marta Coma Vives, Barcelona (ES); Emilio Angulo Navarro, Barcelona (ES); Macia Sole Pans, Sant Quirze del Valles (ES)

(72) Inventors: Marta Coma Vives, Barcelona (ES); Emilio Angulo Navarro, Barcelona (ES); Macia Sole Pons, Sant Quirze del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/569,932

(22) PCT Filed: Jun. 30, 2015

(86) PCT No.: PCT/EP2015/064888
§ 371 (c)(1),
(2) Date: Oct. 27, 2017

(87) PCT Pub. No.: WO2017/000997
PCT Pub. Date: Jan. 5, 2017

(65) Prior Publication Data

US 2018/0154647 A1 Jun. 7, 2018

(51) Int. Cl.
*B41J 2/175* (2006.01)
*B41J 2/18* (2006.01)

(52) U.S. Cl.
CPC ..... *B41J 2/17566* (2013.01); *B41J 2/175* (2013.01)

(58) Field of Classification Search
CPC ..... B41J 2/17566; B41J 2/175; B41J 2/18
See application file for complete search history.

(56) References Cited

U.S. PATENT DOCUMENTS 4,680,696 A 7/1987 Ebinuma et al.
5,189,438 A 2/1993 Hine et al.
(Continued)

FOREIGN PATENT DOCUMENTS

CN 104859310 8/2015
EP 1946849 7/2008
(Continued)

OTHER PUBLICATIONS

L. Riegger et al., "A Dispensing System for Sedimenting Metal Microparticlesolutions Based on a Circulation Mixer Method", 2nd International Conference on MicroFluidic Handling Systems, Oct. 8-10, 2014, 3 pages.

*Primary Examiner* — Jason S Uhlenhake
(74) *Attorney, Agent, or Firm* — HP Inc. Patent Department

(57) ABSTRACT

A printing fluid circulation system is described. The system comprises first and second reservoirs, an outlet to supply printing fluid to a fluid inlet of a printhead, an inlet to receive printing fluid from a fluid outlet of the printhead, and a supply system. The supply system is to operate in a first mode to concurrently supply printing fluid from the first reservoir to the outlet and from the inlet to the second reservoir, and in a second mode to concurrently supply printing fluid from the second reservoir to the outlet and from the inlet to the first reservoir.

14 Claims, 2 Drawing Sheets

(56) References Cited

U.S. PATENT DOCUMENTS

| | | | |
|---|---|---|---|
| 8,444,259 | B2 | 5/2013 | Bennett |
| 8,544,991 | B2 | 10/2013 | Gray et al. |
| 8,757,783 | B2 | 6/2014 | Govyadinov et al. |
| 8,915,572 | B2 | 12/2014 | Levi |
| 2009/0021542 | A1 | 1/2009 | Kanfoush et al. |
| 2010/0039460 | A1* | 2/2010 | Delueg ..... B41J 2/1707 347/7 |
| 2011/0115844 | A1 | 5/2011 | Ozawa |
| 2013/0229473 | A1 | 9/2013 | Wells et al. |
| 2014/0118429 | A1 | 5/2014 | Gengrinovich et al. |

FOREIGN PATENT DOCUMENTS

| | | |
|---|---|---|
| JP | S60137655 | 7/1985 |
| JP | 06-155757 | 6/1994 |
| JP | 2010534574 | 11/2010 |
| JP | 2011088293 A | 5/2011 |
| JP | 2013532594 | 8/2013 |
| KR | 10-1003702 | 7/2008 |
| WO | WO-2007055102 | 5/2007 |
| WO | WO-2011132256 | 10/2011 |

* cited by examiner

PRINTING FLUID CIRCULATION

BACKGROUND

Some printing systems have a reservoir to store printing fluid, such as ink, and a supply system to supply the printing fluid from the reservoir to a printhead, to enable the printhead to apply the printing fluid to a substrate to form an image on the substrate during a print job. The printing fluid may comprise pigment, which lends color to the printed image. The pigment may comprise particles, such as solid and/or opaque particles, that are suspended in the printing fluid.

BRIEF DESCRIPTION OF THE DRAWINGS

Various features of the present disclosure will be apparent from the detailed description which follows, taken in conjunction with the accompanying drawings, which together illustrate, by way of example, features of the present disclosure, and wherein.

DETAILED DESCRIPTION

Some inks and other printing fluids comprise pigment or other particles, which can settle and sometimes agglomerate in a flow path or device when the fluid is at rest. Such a flow path or device can comprise, for example, a tube, a pump, a valve, a tank, or a printhead. The path or device may be part of a supply system that is to supply the printing fluid to a printhead during a print job. Over time, such settling or agglomeration can lead to partial or full blocking of the flow path or device. For example, the settled pigment or particles may make the printing fluid more viscous or form a clot. This can result in the flow of the printing fluid during a subsequent print job being hindered or prevented.

Certain examples as described herein provide a printing fluid circulation system for a printing system, or a method of operating a printing system. Certain examples as described herein enable printing fluid such as ink to be put into motion, such as when a print job is not being performed. This is achieved by causing the printing fluid to move from one area to another, such as from one reservoir to store printing fluid to another reservoir to store printing fluid. In some examples, this movement is via a supply system that is to supply the printing fluid to a printhead during a print job. In some examples, the supply system comprises, and the movement is through, tubes and/or pumps and/or valves and/or tanks. In some examples, the movement is through the printhead. This circulation of the printing fluid can better enable pigment or other particles in the printing fluid to remain suspended in the fluid, such as between print jobs. In some examples, this reduces the risk of the pigment or other particles settling or agglomerating. In some examples, the circulation of printing fluid is a movement of the printing fluid from one volume to another without the printing fluid moving around a complete circuit. That is, the circulation can be an end-to-end movement between the two volumes, such as between reservoirs.

Some examples avoid the need to mechanically vibrate components through which the printing fluid flows in use, which otherwise could be noisy and complex to implement. Some examples avoid the need to purge a supply system or printhead, which otherwise could result in the onset of a subsequent print job being delayed while the printing fluid is reintroduced to the supply system and/or printhead. Some examples avoid the need to flush a supply system or printhead with a cleaning agent other than printing fluid, which could result in printing fluid subsequently becoming contaminated with the cleaning agent when the printing fluid is reintroduced to the supply system and/or printhead.

Figure 1:
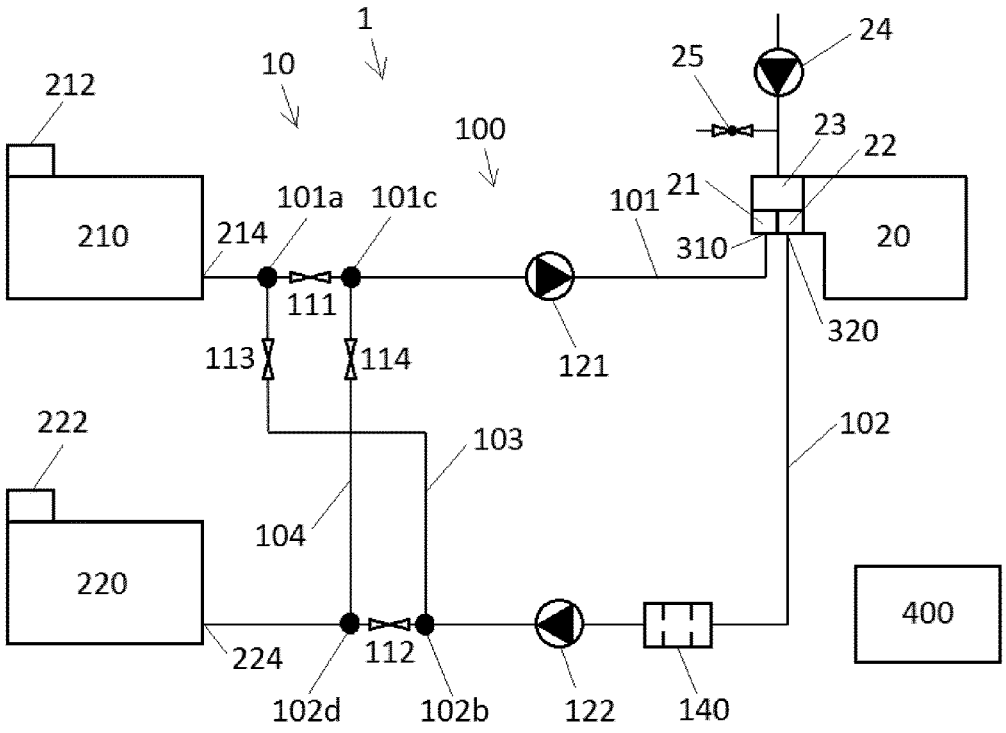
FIG. 1 is a schematic diagram showing a printing system, which comprises a printing fluid circulation system according to an example.

FIG. 1 shows schematically a printing system 1. The printing system 1 comprises a printing fluid circulation system 10 according to an example, and a printhead 20. The printing fluid circulation system 10 of this example comprises a supply system 100, a first reservoir 210, and a second reservoir 220. The printhead 20 has a plurality of nozzles to apply printing fluid to a substrate, such as paper.

The first and second reservoirs 210, 220 may take any form suitable to store printing fluid. For example, the first reservoir 210 may be a tank or other receptacle. The first reservoir 210 may be a closed reservoir or may be open to the atmosphere. The second reservoir 220 may be a tank or other receptacle. The second reservoir 220 may be a closed reservoir or may be open to the atmosphere.

The printing fluid circulation system 10 of this example also comprises an outlet 310 to supply printing fluid to the printhead 20, and an inlet 320 to receive printing fluid from the printhead 30. In this example, the outlet 310 is fluidly connected to a fluid inlet 21 of the printhead 20, and the inlet 320 is fluidly connected to a fluid outlet 22 of the printhead 20. Each of the fluid inlet 21 and fluid outlet 22 may be a needle. In this example, a printhead regulator 23 is located in the printhead 20 between the fluid inlet 21 and the fluid outlet 22. The printhead regulator 23 is described in more detail below. In some examples, the printhead 20 is omitted. Nevertheless, in those examples, the outlet 310 of the supply system 100 is to supply printing fluid to a fluid inlet of a printhead 20, and the inlet 320 of the supply system 100 is to receive printing fluid from a fluid outlet 22 of the printhead 20.

In this example, printing fluid such as liquid ink may be supplied to the outlet 310 from either one of the first and second reservoirs 210, 220. Which one of the first and second reservoirs 210, 220 is to supply printing fluid to the outlet 310 depends on a mode in which the supply system 100 is operating. Moreover, in this example, printing fluid such as liquid ink may be supplied to either one of the first and second reservoirs 210, 220 from the inlet 320, depending on the mode of operation of the supply system 100.

The supply system 100 of this example is to operate in first and second modes. In the first mode, the supply system 100 is to concurrently supply printing fluid from the first reservoir 210 to the outlet 310 and from the inlet 320 to the second reservoir 220. In the second mode, the supply system 100 is to concurrently supply printing fluid from the second reservoir 220 to the outlet 310 and from the inlet 320 to the first reservoir 210. It will be noted that, in this example, in each of the first and second modes of operation, the supply system 100 is to supply printing fluid to the outlet 310 and from the inlet 320. Thus, when the outlet 310 is fluidly connected to the fluid inlet 21 of the printhead 20, and the inlet 320 is fluidly connected to the fluid outlet 22 of the printhead 20, printing fluid may be fed from the supply system 100 and into the printhead 20 via the outlet 310 and the fluid inlet 21, pass through the printhead 20, and then return to the supply system 100 via the fluid outlet 22 and the inlet 320.

The printing fluid circulation system 10 of this example comprises a controller 400 to control operation of the supply system 100. In this example, the controller 400 is to determine in which of the first and second modes the supply system 100 is to operate. The controller 400 may, for example, be an integrated circuit or a microprocessor. The controller 400 may be communicatively connected to the supply system 100.

The supply system 100 will now be described in more detail. In this example, the supply system 100 comprises first to fourth flow paths 101, 102, 103, 104. The first flow path 101 extends from the first reservoir 210 to the outlet 310. The first flow path 101 may fluidly connect the first reservoir 210 and the outlet 310. The second flow path 102 extends from the inlet 320 to the second reservoir 220. The second flow path 102 may fluidly connect the inlet 320 and the second reservoir 220. The third flow path 103 extends from a first point 101*a* on the first flow path 101 to a second point 102*b* on the second flow path 102. The third flow path 103 may fluidly connect the first and second points 101*a*, 102*b*. The fourth flow path 104 extends from a third point 101*c* on the first flow path 101 to a fourth point 102*d* on the second flow path 102. The fourth flow path 104 may fluidly connect the third and fourth points 101*c*, 102*d*. In this example, the third point 101*c* is between the first point 101*a* and the outlet 310, and the fourth point 102*d* is between the second point 102*b* and the second reservoir 220.

In this example, the supply system 100 also comprises first to fourth valves 111, 112, 113, 114 to selectively block the first to fourth flow paths 101, 102, 103, 104, respectively. In this example, the first valve 111 is to selectively block the first flow path 101 at a point between the first and third points 101*a*, 101*c* on the first flow path 101, and the second valve 112 is to selectively block the second flow path 102 at a point between the second and fourth points 102*b*, 102*d* on the second flow path 102. In this example, the third valve 113 is to selectively block the third flow path 103 at a point between the first and second points 101*a*, 102*b*, and the fourth valve 114 is to selectively block the fourth flow path 104 at a point between the third and fourth points 101*c*, 102*d*. In this example, each of the first to fourth valves 111, 112, 113, 114 is an electrovalve. However, in other examples, the valves 111, 112, 113, 114 may be other than electrovalves.

In this example, the controller 400 is to control a state of each of the first to fourth valves 111, 112, 113, 114, in order to control the direction of fluid flow(s) through the supply system 100. The controller 400 may be communicatively connected to the valves 111, 112, 113, 114. In this example, the controller 400 is to cause the first and second valves 111, 112 to be open, and the third and fourth valves 113, 114 to be closed, when the supply system 100 is operating in the first mode. On the other hand, in this example, the controller 100 is to cause the first and second valves 111, 112 to be closed, and the third and fourth valves 113, 114 to be open, when the supply system 100 is operating in the second mode.

The supply system 100 of this example also comprises first and second pumps 121, 122. The first pump 121 is between the third point 101*c* and the outlet 310 in this example. The first pump 121 is fluidly connected between the third point 101*c* and the outlet 310, to pump printing fluid towards the outlet 310 through the first flow path 101 when the supply system 100 is operating in either the first mode or the second mode. In this example, the first pump 121 is to draw ink or other printing fluid from one of the first and second reservoirs 210, 220, depending on the mode of operation of the supply system 100, and to supply the drawn printing fluid to the fluid inlet 21 of the printhead 20. The second pump 122 is between the inlet 320 and the second point 102*b* in this example. The second pump 122 is fluidly connected between the inlet 320 and the second point 102*b*, to pump printing fluid from the inlet 320 through the second flow path 102 when the supply system 100 is operating in either the first mode or the second mode. In this example, the second pump 122 is to extract ink or other printing fluid from the printhead 20 via the fluid outlet 22 of the printhead 20, and to supply the extracted printing fluid to one of the first and second reservoirs 210, 220, depending on the mode of operation of the supply system 100. In some examples, the second pump 122 may be omitted.

In this example, a damper 140 is fluidly connected between the inlet 320 and the second pump 122. In some examples, the second pump 122 may be a diaphragm pump. In use, the diaphragm pump may move successive small volumes of fluid relatively quickly through the second flow path 102. During this operation, the diaphragm pump 122 may first take fluid from an upstream section of the second flow path 102 into a cavity of the diaphragm pump 122 via a pump inlet of the pump 122. Then, the fluid taken into the cavity may be ejected from the cavity to a downstream section of the second flow path 102 via a pump outlet of the pump 122. These actions may cause pressure variation in the second flow path 102, because the pressure of the fluid at the pump inlet and pump outlet changes during operation of the second pump 122. The damper 140 may help provide a smoother printing fluid pressure profile in the second flow path 102. In some examples, the second pump 122 may be a different type of pump, such as a peristaltic pump, and may not create such pressure variation. In some examples, the damper 140 may be omitted.

In this example, the first reservoir 210 has a first fluid port 214, through which printing fluid may pass between the first reservoir 210 and the supply system 100. In this example, the first reservoir 210 is fluidly connected to the supply system 100 just by the first fluid port 214. Therefore, in this example printing fluid to pass from the first reservoir 210 to the supply system 100, or from the supply system 100 to the first reservoir 210, has to pass through the first fluid port 214. In this example, the second reservoir 220 has a second fluid port 224, through which printing fluid may pass between the second reservoir 220 and the supply system 100. In this example, the second reservoir 220 is fluidly connected to the supply system 100 just by the second fluid port 224. Therefore, in this example printing fluid to pass from the second reservoir 220 to the supply system 100, or from the supply system 100 to the second reservoir 220, has to pass through the second fluid port 224. In this example, the supply system 100 is to concurrently supply printing fluid from the first reservoir 210 through the first fluid port 214 and to the second reservoir 220 through the second fluid port 224 when operating in the first mode, and to concurrently supply printing fluid from the second reservoir 220 through the second fluid port 224 and to the first reservoir 210 through the first fluid port 214 when operating in the second mode. This bi-directional operation through the first and second fluid ports 214, 224 may help to keep the first and second fluid ports 214, 224 clear of settled pigment or other particles.

In other examples, there may be more than one fluid port through which printing fluid may pass between the first reservoir 210 and the supply system 100, and/or there may be more than one fluid port through which printing fluid may pass between the second reservoir 220 and the supply system 100.

The printing fluid circulation system 10 of this example also comprises a first detector 212 to detect a volume of printing fluid contained in the first reservoir 210, and a second detector 222 to detect a volume of printing fluid contained in the second reservoir 220. Each of the first and second detectors 212, 222 in this example may take any form suitable to sense how much printing fluid, such as ink, there is present in the respective reservoir 210, 220. Each of the first and second detectors 212, 222 in this example may take any form suitable to sense when there is less than a certain predetermined volume of printing fluid, such as ink, present in the respective reservoir 210, 220. Each of the first and second detectors 212, 222 may, for example, comprise a float that is to move with a level of liquid in the respective reservoir 210, 220, and a switch that is to actuate when the float sinks in the reservoir to below a predetermined position to indicate the volume of liquid in the respective reservoir 210, 220. Other forms of detector 212, 222 may instead be provided in other examples. In some examples, the first detector 212 and/or the second detector 222 may be omitted.

The controller 400 may be communicatively connected to the detectors 212, 222. The controller 400 may determine the volume(s) of printing fluid in the reservoirs 210, 220 on the basis of signal(s) output from the detector(s) 212, 222. In some examples, the controller 400 may be to determine in which one of the first and second modes the supply system 100 is to operate on the basis of a volume of printing fluid in the first reservoir 210 or the second reservoir 220 or both the first and second reservoirs 210, 220. In some examples, the controller 400 may be to cause the supply system 100 to cease operating in the first mode when it is determined, such as following receipt of a signal at the controller 400 from the first detector 212, that the first reservoir 210 contains less than a predetermined volume of printing fluid. In some examples, the controller may be to cause the supply system 100 to cease operating in the second mode when it is determined, such as following receipt of a signal at the controller 400 from the second detector 222, that the second reservoir 220 contains less than a predetermined volume of printing fluid. This can help to avoid damage to the first and/or second pump 121, 122, which could otherwise overheat if pumping too little, or no, fluid.

In this example, in use, and when the supply system 100 is operating in the first mode, each of the first and second valves 111, 112 is open, each of the third and fourth valves 113, 114 is closed, and each of the first and second pumps 121, 122 is operating to pump printing fluid through the first and second flow paths 101, 102, respectively. On the other hand, when the supply system 100 is operating in the second mode in use, each of the first and second valves 111, 112 is closed, each of the third and fourth valves 113, 114 is open, and each of the first and second pumps 121, 122 is operating to pump printing fluid through the first and second flow paths 101, 102, respectively.

Figure 2:
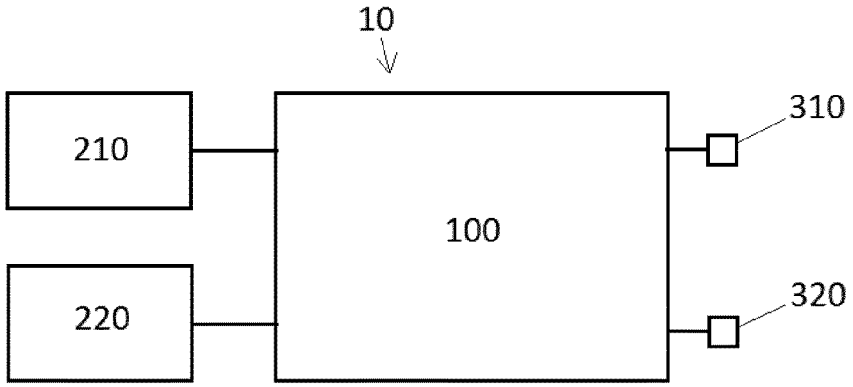
FIG. 2 is a schematic diagram showing a printing fluid circulation system according to another example.

FIG. 2 shows schematically a printing fluid circulation system 10 according to another example. The printing fluid circulation system 10 of this example comprises a first reservoir 210 to store printing fluid, a second reservoir 220 to store printing fluid, an outlet 310 to supply printing fluid to a fluid inlet of a printhead, and an inlet 320 to receive printing fluid from a fluid outlet of the printhead. The printing fluid circulation system 10 of this example also comprises a supply system 100 to operate in a first mode to concurrently supply printing fluid from the first reservoir 210 to the outlet 310 and from the inlet 320 to the second reservoir 220, and in a second mode to concurrently supply printing fluid from the second reservoir 220 to the outlet 310 and from the inlet 320 to the first reservoir 210.

In some examples, when printing fluid in the first reservoir 210 has been exhausted and passed to the second reservoir 220 as a result of operation of the supply system 100 in the first mode, the supply system 100 may subsequently be operated in the second mode so as to then supply the printing fluid from the second reservoir 220 to the first reservoir 210.

Figure 3:
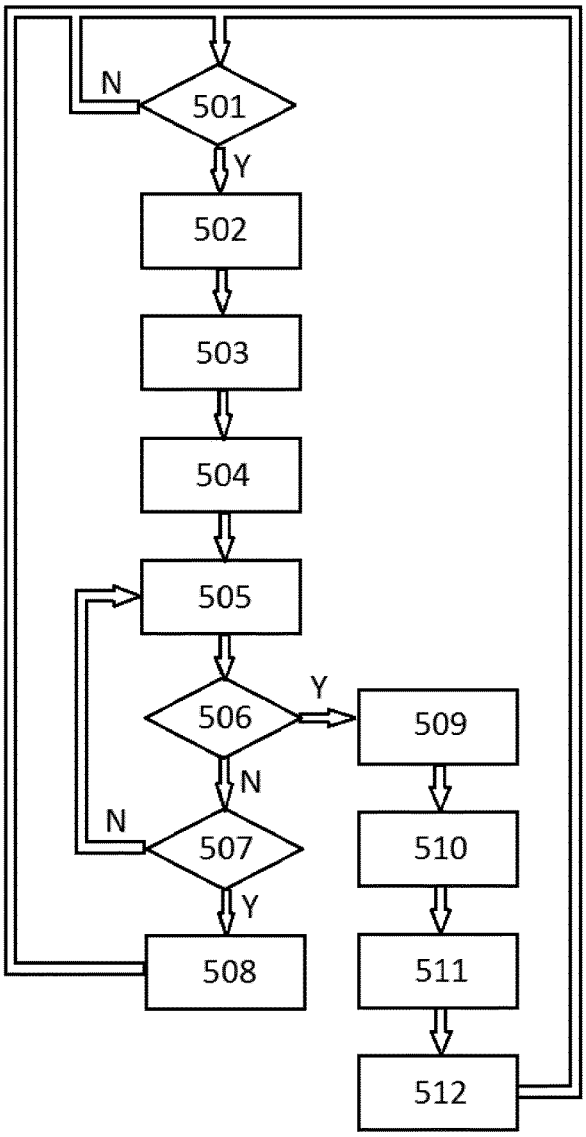
FIG. 3 is a flow diagram showing a method of operating a printing system according to an example.

An example method of operating a printing system 1 will now be described with reference to FIGS. 1 and 3. At block 501, it is determined, such as by the controller 400, whether the printing system 1 has been in an idle state for more than a predetermined period of time. In this example, the printing system 1 is considered to be in an idle state when the printing system 1 is not performing a print job by applying printing fluid to a substrate, and when printing fluid is not being circulated. The predetermined period of time may be, for example, ten minutes, thirty minutes, an hour, two hours, three hours, or four hours. In some examples, the predetermined period of time may be a period of time other than one of the examples listed. When the printing system 1 is in an idle state, the printing fluid may not be in motion. Accordingly, pigment particles or other particles within the printing fluid may be at risk of settling or agglomerating. In this example, if it is determined at block 501 that the printing system 1 has been in an idle state for more than a predetermined period of time, then it is determined that circulation of printing fluid is to be performed and the method moves to block 502. If the determination at 501 is that the printing system 1 has not been in an idle state for more than the predetermined period of time, then the method returns to block 501.

In some examples, block 501 may be omitted. In some examples, the method may be performed for some or all of the time that the printing system 1 is not performing a print job. In some examples, the method may be performed periodically when the printing system 1 is not performing a print job, such as every X minutes. X may be, for example, ten minutes, thirty minutes, sixty minutes, one hundred twenty minutes, one hundred eighty minutes, or two hundred forty minutes.

In this example of the method, at block 502 it is then determined which one of the first and second printing fluid tanks 210, 220 of the printing system 1 is to supply printing fluid to the fluid inlet 21 of the printhead 20 of the printing system 1. This determination could, for example, be made on the basis of the following factor(s): (a) which one of first and second reservoirs 210, 220 of the printing system 1 last supplied printing fluid to the fluid inlet 21 of the printhead 20, and/or (b) a volume of printing fluid in the first reservoir 210, and/or (c) a volume of printing fluid in the second reservoir 220. In some examples, when it is determined that one of first and second reservoirs 210, 220 of the printing system 1 last supplied printing fluid to the fluid inlet 21 of the printhead 20, then it may be determined that the same one of the first and second reservoirs 210, 220 is to supply printing fluid to the fluid inlet 21. This may be to reduce the number of valves that need to be actuated to suitably set the supply system 100 to enable circulation of printing fluid.

In some examples, when it is determined that a volume of printing fluid in one of the first and second reservoirs 210, 220 is less than a predetermined volume, and the volume of printing fluid in the other of the first and second reservoirs 210, 220 is not less than a predetermined volume, then it may be determined that the other of the first and second reservoirs 210, 220 is to supply printing fluid to the fluid inlet 21. This would enable circulation of printing fluid to be performed with a greater volume of printing fluid, because the source of printing fluid for the circulation process would be the reservoir 210, 220 containing the greater volume of printing fluid.

In this example the method then moves to block 503, at which the printhead regulator 23 is opened. Ordinarily, a bag of the regulator 23 is fluidly connected to the atmosphere by a regulator valve 25 being in an open state, so as to be at atmospheric pressure. The regulator 23 is opened by the regulator valve 25 being closed and a regulator pump 24 blowing air into the bag of the regulator 23. Opening of the regulator 23 causes the fluid outlet 22 of the printhead 20 to be opened. In some examples, such as examples in which the printhead is of a different type to the printhead 20 described herein, the regulator pump 24 and/or the regulator valve 25 and/or the printhead regulator 23 may be omitted.

In this example, the method then moves to block 504, at which it is provided that the one of the first and second reservoirs 210, 220 is fluidly connected to the fluid inlet 21, and that the fluid outlet 22 is fluidly connected to the other of the first and second reservoirs 210, 220. In some examples, the valves 111-114 of the supply system 100 may already be suitably set so that these fluid connections are already present. In other examples, one or some or all of the valves 111-114 may be opened or closed, for example under the control of the controller 400, so as to provide the fluid connections. In some examples, block 503 may be performed before block 504, or after block 504, or simultaneously with block 504.

In this example, the method then moves to block 505, at which printing fluid is supplied from the one of the first and second reservoirs 210, 220 to the fluid inlet 21, and from the fluid outlet 22 to the other of the first and second reservoirs 210, 220. In this example, this comprises the first pump 121 being operated, for example under the control of the controller 400, so as to pump printing fluid towards the outlet 310 through the first flow path 101. In some examples, this also comprises the second pump 122 being operated, for example under the control of the controller 400, so as to pump printing fluid from the inlet 320 through the second flow path 102. This circulation of printing fluid helps to prevent pigment or particles within the printing fluid from settling or agglomerating in the supply system 100 or in the printhead 20, which could otherwise result in flow of the printing fluid during a subsequent print job being hindered or prevented. The printing fluid may be supplied from the one of the first and second reservoirs 210, 220 to the fluid inlet 21, through the printhead 20, and then from the fluid outlet 22 to the other of the first and second reservoirs 210, 220. In some examples, block 503 may be performed before block 505, or simultaneously with block 505, or after block 505.

In this example, the method then moves to block 506, at which it is determined, such as by the controller 400 for example on the basis of a signal received from a print driver, whether a print job on a substrate is to be performed. If it is determined at block 506 that a print job is to be performed, then the method moves to block 509, discussed below. If it is determined at block 506 that a print job is not to be performed, then the method moves to block 507.

In this example, at block 507 it is determined, such as by the controller 400 on the basis of a signal output from one of the detectors 212, 222, whether the one of the reservoirs 210, 220 from which printing fluid is being sourced contains less than a predetermined volume of printing fluid. If the determination at block 507 is "no", then the method of this example returns to block 505, so that the circulation of printing fluid continues. However, if the determination at block 507 is "yes", then the method of this example moves to block 508, at which the supply system 100 ceases operating in the current one of the first and second modes, for example under the control of the controller 400. For example, the controller 400 may cause the first and second pumps 121, 122 to cease pumping. Accordingly, circulation of printing fluid stops. The method then returns to block 501.

In a subsequent performance of the method, at block 504 it may be provided that the other of the first and second reservoirs 210, 220 is fluidly connected to the fluid inlet 21, and that the fluid outlet 22 is fluidly connected to the one of the first and second reservoirs 210, 200. Correspondingly, at block 505 printing fluid may be supplied from the other of the first and second reservoirs 210, 220 to the fluid inlet 21, and from the fluid outlet 22 to the one of the first and second reservoirs 210, 220. Accordingly, the printing fluid may flow in different flow paths of the supply system 100 as compared to the flow paths of the supply system 100 used in the first instance of block 505 discussed above. Accordingly, this can enable printing fluid to be moved through more of the supply system 100, which can further help avoid or reduce agglomeration of pigment or particles in the supply system 100.

In this example, at block 509 it is provided that a particular one of the first and second reservoirs 210, 220 is fluidly connected to the fluid inlet 21 of the printhead 20. The particular one of the first and second reservoirs 210, 220 may be the one of the first and second reservoirs 210, 220 that was supplying printing fluid to the fluid inlet 21 at block 505. Alternatively, the particular one of the first and second reservoirs 210, 220 may be the other of the first and second reservoirs 210, 220, in which case one or some or all of the valves 111-114 may be opened or closed, for example under the control of the controller 400, so as to provide the fluid connection. In this example, at block 509 valve 112 is closed, for example under the control of the controller 400, so as to prevent fluid flow through the second flow path 102. The method then moves to block 510.

In this example, at block 510 printing fluid is supplied from the particular one of the first and second reservoirs 210, 220 to the fluid inlet 21. In this example, this comprises the first pump 121 being operated, for example under the control of the controller 400, so as to pump printing fluid towards the outlet 310 through the first flow path 101. In this example, the second pump 122 is not operated, since the second flow path 102 is blocked by the second valve 112. The method then moves to block 511.

In this example, at block 511 printing fluid is fed from the fluid inlet 21 of the printhead 20 to the nozzle of the printhead 20, to apply printing fluid to the substrate during the print job. When the print job is completed, the method moves to block 512, at which the supply system 100 ceases supplying printing fluid to the fluid inlet 21, for example under the control of the controller 400. For example, the controller 400 may cause the first pump 121 to cease pumping. The method then returns to block 501.

Figure 4:
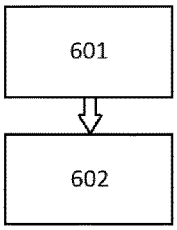
FIG. 4 is a flow diagram showing a method of operating a printing system according to another example.

Another example method of operating a printing system will now be described with reference to FIG. 4. The printing system of this example comprises a first reservoir to store printing fluid, a second reservoir to store printing fluid, a printhead having a fluid inlet and a fluid outlet, and a supply system to supply printing fluid from either one of the first and second reservoirs to the fluid inlet, and to supply printing fluid from the fluid outlet to either one of the first and second reservoirs. At block 601 of the method, it is provided that one of the first and second reservoirs is fluidly connected to the fluid inlet, and that the fluid outlet is fluidly connected to the other of the first and second reservoirs. In some examples, the supply system 100 may already be suitably prepared so that these fluid connections are already present. In other examples, the supply system 100 may undergo some change or reconfiguration so as to provide the fluid connections.

The method then moves to block 602, at which printing fluid is supplied from the one of the first and second reservoirs to the fluid inlet, and from the fluid outlet to the other of the first and second reservoirs. In some examples, the supply system may comprise a pump, and this process may comprise the pump being operated so as to pump printing fluid from the one of the first and second reservoirs towards the fluid inlet. In some examples, the supply system may comprise a second pump, and this process may comprise the second pump being operated so as to pump printing fluid from the fluid outlet to the other of the first and second reservoirs. This circulation of printing fluid helps to prevent pigment particles or other particles within the printing fluid from settling or agglomerating in the supply system or in the printhead, which could otherwise result in flow of the printing fluid during a print job being hindered or prevented.

Some examples provide a non-transitory computer-readable storage medium comprising a set of computer-readable instructions stored thereon, which, when executed by a processor of a printing system, cause the processor to determine which one of first and second printing fluid tanks of the printing system is to supply printing fluid to a fluid inlet of a printhead of the printing system, and to cause a supply system of the printing system to supply printing fluid from the one of the first and second printing fluid tanks to the fluid inlet concurrently with supplying printing fluid from a fluid outlet of the printhead to the other of the first and second printing fluid tanks. In some examples, the printing system may be that shown in FIG. 1, in which case the first and second printing fluid tanks may be the first and second reservoirs 210, 220, the printhead and fluid inlet and fluid outlet thereof may be the printhead 20, fluid inlet 21 and fluid outlet 22, and the supply system may be the supply system 100. In some such examples, the controller 400 of the printing system 1 may comprise the processor.

In some examples, the non-transitory computer-readable storage medium may comprise any one of many physical media such as, for example, electronic, magnetic, optical, electromagnetic, or semiconductor media. More specific examples of suitable non-transitory computer-readable storage media include, but are not limited to, a portable magnetic computer diskette such as floppy diskettes or hard drives, a read-only memory ("ROM"), an erasable programmable read-only memory, a portable compact disc or other storage devices that may be coupled to the processor directly or indirectly. Alternatively, the non-transitory computer-readable storage medium may be a random access memory ("RAM") device. The non-transitory computer-readable storage medium may comprise any combination of one or more of the foregoing and/or other devices as well. In some examples, the processor may comprise a microprocessor.

Certain examples described herein provide a system or method to help avoid the settling or agglomeration of pigment or particles of printing fluid, which could otherwise result in flow of the printing fluid during a print job being hindered or prevented. An advantage of some examples is a reduced wastage of printing fluid.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printing fluid circulation system for a printing system, the printing fluid circulation system comprising:

a first reservoir to store printing fluid;

a second reservoir to store printing fluid;

an outlet to supply printing fluid to a fluid inlet of a printhead;

an inlet to receive printing fluid from a fluid outlet of the printhead; and a supply system to operate in a first mode to concurrently supply printing fluid from the first reservoir to the outlet and from the inlet to the second reservoir, and in a second mode to concurrently supply printing fluid from the second reservoir to the outlet and from the inlet to the first reservoir.

2. The printing fluid circulation system according to claim 1, comprising a controller to determine in which of the first and second modes the supply system is to operate.

3. The printing fluid circulation system according to claim 2, comprising a first detector to detect a volume of printing fluid contained in the first reservoir, and a second detector to detect a volume of printing fluid contained in the second reservoir; and wherein the controller is to determine in which one of the first and second modes the supply system to operate on the basis of a volume of printing fluid in one or each of the first and second reservoirs.

4. The printing fluid circulation system according to claim 1, comprising a detector to detect a volume of printing fluid contained in the first reservoir; and a controller to control operation of the supply system;

wherein the controller is to cause the supply system to cease operating in the first mode when the detector detects that the first reservoir contains less than a predetermined volume of printing fluid.

5. The printing fluid circulation system according to claim 1, comprising a controller to control operation of the supply system;

wherein the controller is to cause the supply system to operate in the first mode or in the second mode, when the printing system has been in an idle state for more than a predetermined period of time.

6. The printing fluid circulation system according to claim 1, wherein the first reservoir has a first fluid port and the second reservoir has a second fluid port;

wherein the supply system is to concurrently supply printing fluid from the first reservoir through the first fluid port and to the second reservoir through the second fluid port when operating in the first mode; and wherein the supply system is to concurrently supply printing fluid from the second reservoir through the second fluid port and to the first reservoir through the first fluid port when operating in the second mode.

7. The printing fluid circulation system according to claim 1, wherein the supply system comprises:

a first flow path extending from the first reservoir to the outlet;

a second flow path extending from the inlet to the second reservoir;

a third flow path extending from a first point on the first flow path to a second point on the second flow path;

a fourth flow path extending from a third point, between the first point and the outlet, on the first flow path to a fourth point, between the second point and the second reservoir, on the second flow path;

a first valve to selectively block the first flow path at a point between the first and third points;

a second valve to selectively block the second flow path at a point between the second and fourth points;

a third valve to selectively block the third flow path at a point between the first and second points;

a fourth valve to selectively block the fourth flow path at a point between the third and fourth points; and a controller to control a state of each of the first to fourth valves;

wherein the controller is to cause the first and second valves to be open and the third and fourth valves to be closed when the supply system is operating in the first mode; and wherein the controller is to cause the first and second valves to be closed and the third and fourth valves to be open when the supply system is operating in the second mode.

8. The printing fluid circulation system according to claim 7, wherein the supply system comprises a first pump between the third point and the outlet, and wherein the first pump is to pump printing fluid towards the outlet through the first flow path when the supply system is operating in the first mode or in the second mode.

9. The printing fluid circulation system according to claim 8, wherein the supply system comprises a second pump between the inlet and the second point, and wherein the second pump is to pump printing fluid from the inlet through the second flow path when the supply system is operating in the first mode or in the second mode.

10. A method of operating a printing system, the printing system comprising a first reservoir to store printing fluid; a second reservoir to store printing fluid; a printhead having a fluid inlet and a fluid outlet; and a supply system to supply printing fluid from either one of the first and second reservoirs to the fluid inlet, and to supply printing fluid from the fluid outlet to either one of the first and second reservoirs; the method comprising:

providing that one of the first and second reservoirs is fluidly connected to the fluid inlet, and that the fluid outlet is fluidly connected to the other of the first and second reservoirs;

supplying printing fluid from the one of the first and second reservoirs to the fluid inlet, and from the fluid outlet to the other of the first and second reservoirs;

providing that the other of the first and second reservoirs is fluidly connected to the fluid inlet, and that the fluid outlet is fluidly connected to the one of the first and second reservoirs; and supplying printing fluid from the other of the first and second reservoirs to the fluid inlet, and from the fluid outlet to the one of the first and second reservoirs.

11. The method according to claim 10, comprising opening a printhead regulator of the printhead prior to the providing or the supplying.

12. The method according to claim 10, comprising performing the method when the printing system has been in an idle state for more than a predetermined period of time.

13. The method according to claim 10, wherein the printhead has a nozzle to apply printing fluid to a substrate, and wherein the method comprises:

determining that a print job on a substrate is to be performed;

providing that a particular one of the first and second reservoirs is fluidly connected to the fluid inlet;

supplying printing fluid from the particular one of the first and second reservoirs to the fluid inlet; and feeding printing fluid from the fluid inlet to the nozzle to apply printing fluid to the substrate.

14. A non-transitory computer-readable storage medium comprising a set of computer-readable instructions stored thereon, which, when executed by a processor of a printing system, cause the processor to:

determine which one of first and second printing fluid tanks of the printing system is to supply printing fluid to a fluid inlet of a printhead of the printing system; and cause a supply system of the printing system to supply printing fluid from the one of the first and second printing fluid tanks to the fluid inlet concurrently with supplying printing fluid from a fluid outlet of the printhead to the other of the first and second printing fluid tanks.

* * * * *